United States Patent [19]

Peterson et al.

[11] Patent Number: 4,998,759

[45] Date of Patent: Mar. 12, 1991

[54] DOOR STRIKER ASSEMBLY

[75] Inventors: Francis C. Peterson, Woodbury, Conn.; Alamantas K. Paskonis, Parma, Ohio

[73] Assignee: Buell Industries, Inc., Waterbury, Conn.

[21] Appl. No.: 424,521

[22] Filed: Oct. 20, 1989

[51] Int. Cl.[5] ..... E05B 15/02

[52] U.S. Cl. ..... 292/340; 292/DIG. 53

[58] Field of Search ..... 292/340, 341.11, 341.12, 292/341.15, 341.16, 341.18, DIG. 67, DIG. 43, DIG. 23, DIG. 31, DIG. 40, DIG. 41, DIG. 14, DIG. 53, 213, 214, 215, 216, 217, 218, 281, 198; D8/343, 344, 345

[56] References Cited

U.S. PATENT DOCUMENTS

| | | | |
|---|---|---|---|
| 4,202,571 | 5/1980 | Nishikoori | 292/216 |
| 4,466,645 | 8/1984 | Kobayashi | 292/341.12 |
| 4,470,626 | 9/1984 | Gergoe et al. | 292/341.12 |
| 4,602,813 | 7/1986 | Gergoe et al. | 292/DIG. 43 X |
| 4,624,491 | 11/1986 | Vincent | 292/216 X |
| 4,650,231 | 3/1987 | Shimura et al. | 292/340 |
| 4,756,565 | 7/1988 | Myslicki et al. | 292/340 |

FOREIGN PATENT DOCUMENTS

| | | | |
|---|---|---|---|
| 272116 | 7/1988 | European Pat. Off. | 292/340 |
| 2033954 | 5/1980 | United Kingdom | 292/216 |

*Primary Examiner*—Eric K. Nicholson

*Attorney, Agent, or Firm*—St. Onge Steward Johnston & Reens

[57] ABSTRACT

A door striker assembly for mounting in a vehicle door receiving aperture for engagement with a vehicle door latch. The striker has a bracket adapted to be mounted in the door aperture. The bracket has two sections joined together at an angle, and a generally L-shaped rod extends between the bracket sections. The ends of the rod are rigidly joined to the bracket sections. The base area joining the bracket sections has a width between about 2.5 to about 7.5 times the diameter of the rod. The rod is adapted to be engaged by the vehicle door latch mechanism. The bracket, rod, and a revetment cooperate to form a rigid assembly. The assembly prevents vehicle door parts from being trapped by the door striker during a collision, which improves vehicle safety by minimizing the possibility of the vehicle door being jammed shut.

25 Claims, 2 Drawing Sheets

DOOR STRIKER ASSEMBLY

FIELD OF THE INVENTION:

The present invention relates to a door striker for receiving a latching mechanism of a motor vehicle door, which improves vehicle safety by preventing the vehicle door from being trapped behind the striker during a collision, thereby minimizing the likelihood that the door will become jammed shut. The door striker of the present invention is adapted for use with swinging and sliding doors, and has exceptional strength to resist both transverse and longitudinal forces.

BACKGROUND OF THE INVENTION

When a motor vehicle collides with another object, the force of the collision will often cause the door to become jammed shut. This problem occurs because portions of the door become trapped behind the door striker. This may occur in motor vehicles of unibody construction by a shortening of the vehicle frame in front end and rear end collisions, which causes the door striker to be forced into the door edge, so that the door surrounds and is trapped by the door striker. In sideways collisions, the door may be extruded behind the door striker by the force of the collision. As a result, it often requires extraordinary effort to remove trapped motorists from the vehicle. If the motorist has been injured in the collision, the delay in extricating the motorist may impede rapid medical treatment.

This problem has arisen with door strikers commonly used in the industry. For example, the basic door striker 400 shown in FIG. 4 which is generally bolt shaped suffers from this problem. So too does a well known prior art door striker which has a staple shape. Each of these designs is undesirable in a collision because they permit portions of the door to become trapped between the door striker 400 and the door pillar 406 in the areas shown as 410. The trapped door portions prevent the door from being readily opened.

A door striker 500, shown in FIG. 5 has been proposed to alleviate this problem. Door striker 500 comprises a bolt 502 and separate J-shaped piece 504. Bolt 502 is mounted to the door pillar 506. The J-shaped piece has an aperture 507 through which the bolt 502 extends, and a lip section 509 which fits into area 510 adjacent the door pillar. It has been found that this design is unsatisfactory in practice, because in a collision, the door will still extrude around the bolt and/or the lip section 509 of the J-shaped piece 504 will deform, permitting the door to become jammed behind the bolt 502 in the area 510. Moreover, since the door striker 500 is secured to the door pillar by a single fastener, the force of a collision can cause the bolt 502 to be displaced away from the J-shaped piece, also allowing the door to be trapped behind the bolt 502. In addition, the single fastener design is not desireable since it may in time become loosened and may detach from the door pillar.

SUMMARY OF THE INVENTION

It is an object of the present invention to provide a door striker for a vehicle door which prevents the collapse and trapping of a vehicle door behind the door striker by providing a rigid door striker assembly which can be securely anchored to the vehicle body. It is an object of the invention to provide a door striker adapted for use both with swinging and sliding doors. It is an object of the invention to provide a door striker of substantial structural strength having a very high resistance to both lateral and longitudinal forces.

In accordance with the invention, the door striker comprises an integral bracket having two sections joined together at an angle, means for engagement with the vehicle door latch mechanism which extends between and is rigidly affixed to the bracket sections, and means for mounting the bracket to the vehicle body, the means for engagement and the integral bracket together forming a rigid structure. The means for engagement preferably comprises a bent rod having two sections which intersect and are joined to the bracket sections. Most preferably, one section of the bent rod extends generally perpendicularly and one section extends generally parallel to the vehicle door when the door is closed. The bracket preferably has a revetment extending between the points of affixation of the rod sections to the bracket sections. The means for mounting preferably comprises apertures located laterally of the rod which receive fasteners there through to fasten the door striker to the vehicle body.

Other objects, aspects and features of the present invention in addition to those mentioned above will be pointed out in or will be understood from the following detailed description provided in conjunction with the accompanying drawings.

DETAILED DESCRIPTION OF THE PREFERRED EMBODIMENT

Figure 1:
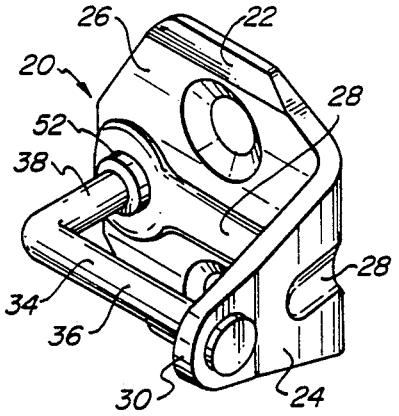
FIG. 1 is a perspective view of a door striker in accordance with the invention.
Figure 2:
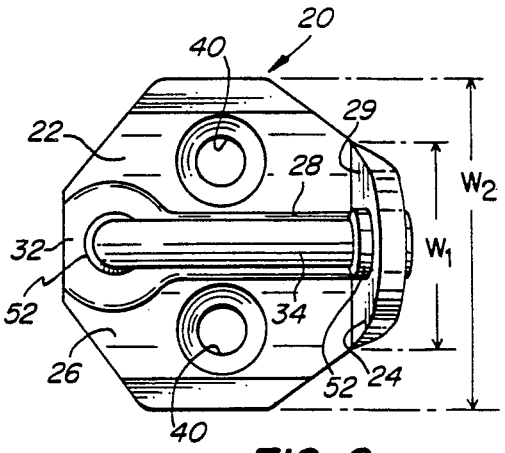
FIG. 2 is a side elevation view showing a door striker of the invention.
Figure 3:
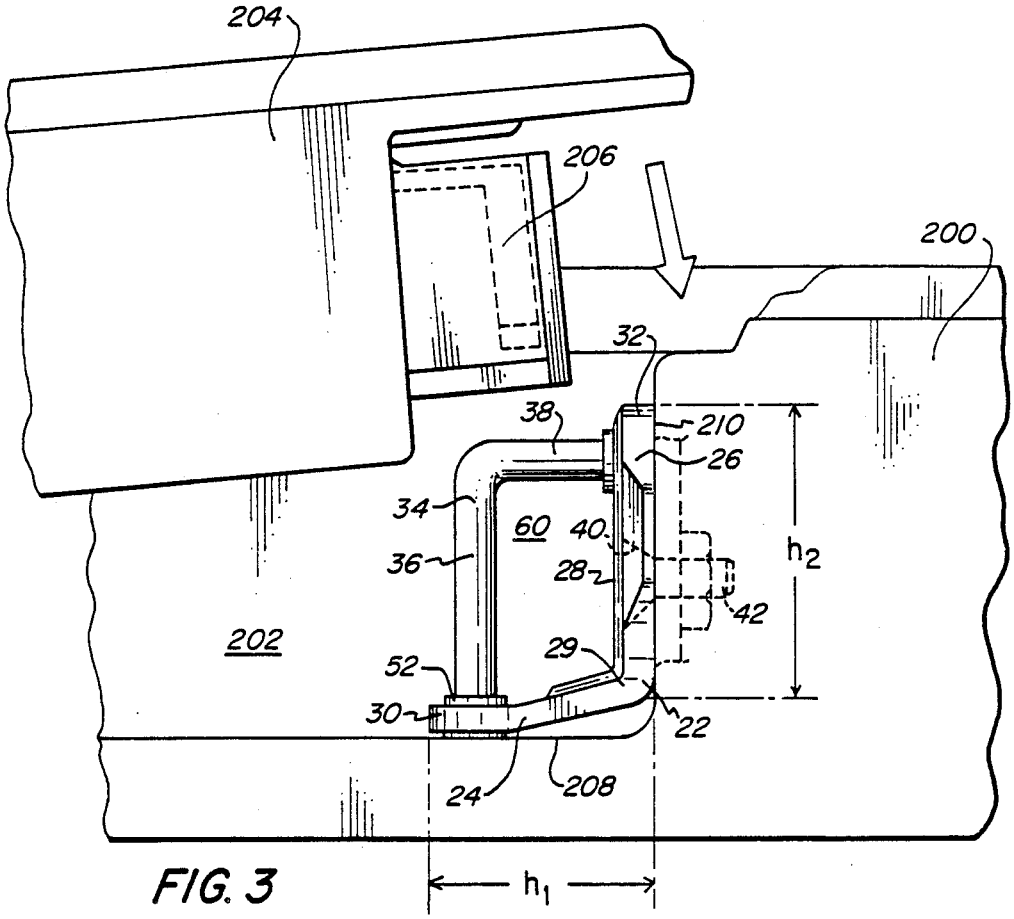
FIG. 3 is a top cross-sectional view showing a door striker of the invention installed in a motor vehicle.
Figure 4:
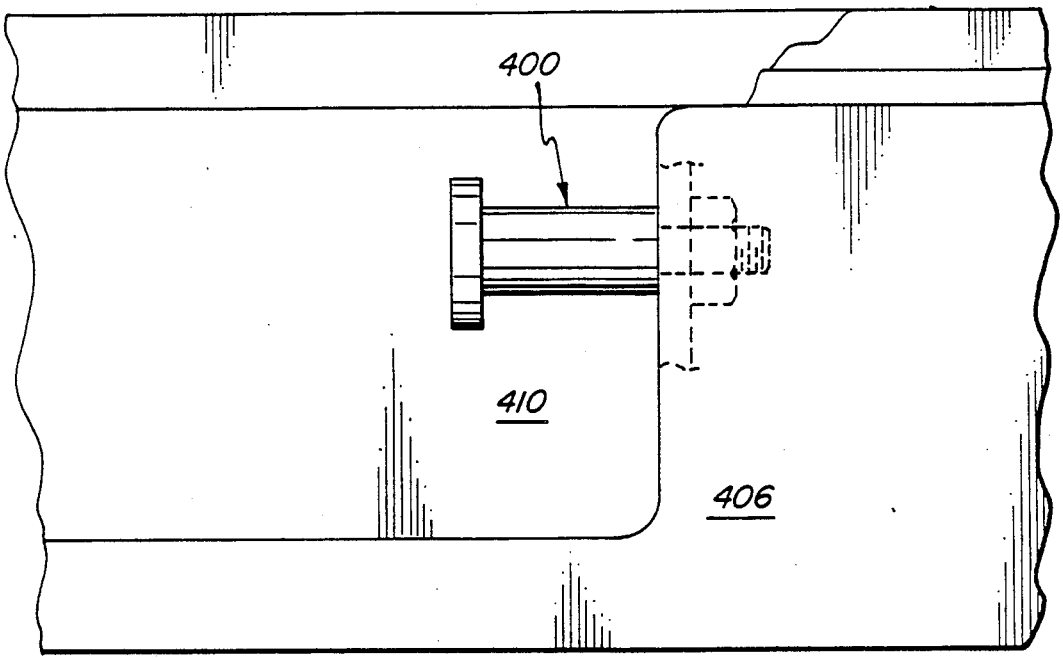
FIG. 4 (PRIOR ART)
FIG. 4 is a top cross-sectional view showing a prior art door striker installed in a motor vehicle.
Figure 5:
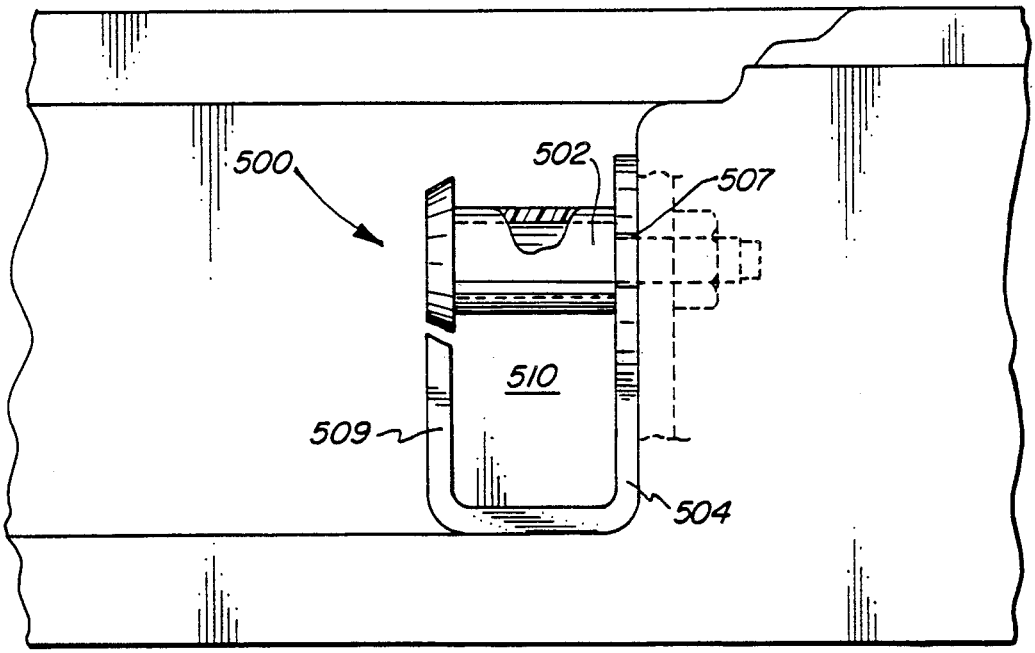
FIG. 5 (PRIOR ART)
FIG. 5 is a top cross-sectional view showing a prior art door striker installed in a motor vehicle.

Referring to FIGS. 1–3, a door striker assembly, shown as 20, is adapted for mounting in a vehicle body 200 having a vehicle door receiving aperture 202 and a vehicle door 204. The vehicle door 204 has a door latch mechanism 206. The vehicle door receiving aperture 202 may include two panels 208 and 210 at angles to each other. Panel 208 extends generally parallel to the vehicle door 204 in its closed position. Panel 210 extends generally perpendicularly to the vehicle door 204 in its closed position. Either or both of panels 208 and 204 are typically part of a door pillar of the motor vehicle.

Door striker 20 is formed of an integral metal bracket 22. Bracket 22 has two sections 24 and 26 which are formed at an angle to each other. It is preferable that the angle between bracket sections 24 and 26 be at a ninety degree angle, as this will enhance the overall rigidity of the door striker, but if this angle does not match the angle between panels 208 and 210, an angle between bracket sections 24 and 26 will be selected to match the angle between panels 208 and 210 of the motor vehicle body. The angle between panels 208 and 210 will typically be at a ninety degree angle, but may be at a different angle depending on the engineering and manufacturing considerations relevant to the manufacture of the motor vehicle.

The bracket sections 24 and 26 are preferably generally polygonal in shape with rounded corners and are joined at their bases. A triangular shape is desireable to reduce weight while still providing excellent structural rigidity, however, other shapes such as rectangles, pentagons, trapezoids, other polygons and semicircles may also be used within the scope of the invention without departure from its conception. Bracket section 24 is preferably smaller than bracket section 26 which is larger to accommodate means for mounting the door striker 20 to the vehicle body and to provide support for lateral forces applied to rod 34. In the most preferred embodiment bracket section 24 is generally triangular and has a height $h_1$ which is about 0.8 to about 1.2 times the width $w_1$ of its base.

Bracket section 26 is most preferably generally hexagonal. The height $h_2$ of bracket section 26 will be in the range of about 1.0–1.6 times the height $h_1$ of bracket section 24. In the hexagonal embodiment, bracket section 26 will have a maximum width $w_2$ which is about 1.0–1.4 times its height $h_2$. Of course, other shapes and dimensions may also be used, and for example, if both bracket sections 24 and 26 are triangular and joined at their bases, the maximum widths of the sections 24 and 26 will be equal.

Base area 29 joining the bracket sections 24 and 26 has a sufficient width to provide the bracket sections 24 and 26 with compressive and tensioning strength by a triangular force distribution, to resist substantial transverse forces on rod 34. The width of base area 29 between the bracket sections 24 and 26 is preferably in the range of about 2.5 to about 7.5 times the diameter of the rod 34, and is most preferably in the range of about 4.0 to about 5.0 times the diameter of rod 34. As shown in FIG. 2, the base area 29 has a width which will be the same as the width $w_1$ of bracket section 24.

A revetment 28 may be provided in the bracket 22. Revetment 28 comprises a ridge of the bracket 22 material which extends towards the space between bracket sections 24 and 26. Revetment 28 preferably extends from the join 29 between the bracket sections 24 and 26 towards the apices 30 and 32 of the bracket sections 24 and 26. Revetment 28 most preferably extends to about the midpoint of bracket section 24 and to the apex 32 of bracket section 26. As used herein, the terms "apex" or "apices" do not necessarily connote a polygonal bracket section shape, but rather is meant to describe the free ends of the bracket sections, regardless of their particular shape.

The door striker 20 includes means for engagement with the motor vehicle door latch mechanism 206. The means for engagement extends between and is rigidly joined to the bracket sections 24 and 26. The means for engagement preferably comprises a bent rod 34. Rod 34 has two sections which intersect and rigidly join with the bracket sections 24 and 26. Where the bracket sections 24 and 26 are triangular and hexagonal, the rod 34 sections are rigidly joined to the bracket sections generally in the area of the apices of the bracket sections 24 and 26. The revetment 28 will preferably be located in the line between where the rod 34 sections join the bracket sections 24 and 26. In the most preferred embodiment, the rod 34 is L-shaped, that is, it is bent at a ninety degree angle, with rod sections 36 and 38 extending perpendicularly into the bracket sections 24 and 26. In the most preferred embodiment, rod section 36 will have a length which is in the range of about 1.2 to about 2.0 times the length of rod section 38.

When the door striker 20 is mounted in the vehicle body for use with a standard door latch mechanism, one section 36 of the bent rod 34 will usually extend generally perpendicularly to the vehicle door 204 in its closed position while the other section 38 will extend generally parallel to the vehicle door 204 in its closed position.

Means for mounting the door striker to the vehicle are provided. In the preferred embodiment, these comprise two countersunk apertures 40 located in at least one of the bracket sections 24 and 26 to receive fasteners 42 therethrough to fasten the door striker 20 to the vehicle body 200. The apertures 40 are located laterally of the bent rod 34. In the most preferred embodiment, the two apertures 40 are located in the hexagonal bracket section 26. In the usual mounting orientation the apertures 40 of the door striker 20 will be located against panel 210 of vehicle body 200, and fasteners 42 will fasten door striker 20 to panel 210.

It is to be appreciated that the foregoing elements of the door striker 20 cooperate to form an assembly which is extremely rigid and strong, and which is unlikely to be affected by forces generated in a motor vehicle collision. This prevents the door striker from collapsing during a collision, which could cause the vehicle door to be jammed shut. The door striker, 20 of the present invention withstands longitudinal forces (i.e. both compressive and pulling forces in the plane of the bent rod 34) in excess of 5500 pounds force, and transverse forces (i.e. forces perpendicular to the plane of the bent rod 34) in excess of 5000 pounds force.

The door striker of the present invention is shown mounted in a vehicle body in FIG. 3. As can be seen, the bracket sections closely conform with, abut, and/or are fastened to the panels 208 and 210. The bent rod 34 creates a protected space 60. In a collision, the door is prevented from collapsing into the protected space 60 by the bent rod 34. The rigidity and structural strength of the door striker 20 insures that the bent rod 34 will not be displaced. As a result, the door does not become jammed in a collision.

The door striker of the present invention may be manufactured by die forming a bracket 22 from a heavy grade of spring steel, preferably 0.1–0.2 inch in thickness, and most preferably 0.125 inch in thickness, by which an angled bracket having a revetment 28 and fastener receiving apertures 40 as well as apertures for receiving the rod sections 36 and 38 is formed. The bracket 22 will be formed with bracket sections 24 and 26 at an angle to each other which is slightly larger than the angle that is ultimately desired. The rod 34 is bent from from heavy wire stock, preferably 5/16 inch in diameter, into its desired shape, and collars 52 are formed by cold heading. Collars 52 are located at the ends of the rod sections where they seat into the rod receiving apertures. The ends of sections 36 and 38 of the bent rod 34 are inserted into the rod receiving apertures, and the bracket 22 is bent to its final shape. The ends of the sections 36 and 38 of the rod are then flared to secure the rod 34 to the bracket 22.

The door striker 20 of the present invention is useful with both swinging and sliding doors. As shown mounted in a motor vehicle in FIG. 3, the rod section 38 is suited to be engaged by the door latch 206 of a swinging door 204, which approaches the door striker from its outward facing side. The rod section 36 is suited to be engaged by a sliding door which would approach the door striker 20 from its lateral side.

Therefore, the present invention represents a substantial improvement in the art, as it provides improved safety in a collision by preventing door collapse around the door striker which could cause the door to become jammed. The present invention provides a door striker suitable for use with both swinging and sliding doors, and demonstrates exceptional strength in the face of both transverse and longitudinal forces.

We claim:

1. A door striker assembly for a vehicle having a vehicle door and a vehicle door receiving aperture, the vehicle door being movable from an open to a closed position, and having a vehicle door latch mechanism, the vehicle door receiving aperture including two panels at an angle of substantially less than 180 degrees to each other, comprising:

an integral bracket having two sections joined together in a base area at an angle selected to permit said bracket sections to fit against and closely abut the two panels of the vehicle door aperture, the joining base area between said sections having a substantial width to provide substantial structural strength to said bracket;

means for engagement with the vehicle door latch mechanism, said engagement means extending between and being rigidly affixed to said bracket sections;

means for mounting said bracket to the vehicle door receiving aperture;

said means for engagement and said bracket forming a rigid structure.

2. A door striker assembly in accordance with claim 1 wherein said means for engagement comprises a rod having a diameter and two sections, the sections of said rod intersecting and being joined with said bracket sections.

3. A door striker assembly in accordance with claim 2 wherein one section of said rod extends generally perpendicularly to the vehicle door in its closed position and one section of said bent rod extends generally parallel to the vehicle door in its closed position.

4. A door striker assembly in accordance with claim 2 wherein said bracket further comprises a revetment located between the intersections of said rod sections with said bracket sections.

5. A door striker assembly in accordance with claim 1 wherein said means for mounting comprises apertures located in at least one of said bracket sections laterally of said means for engagement for receiving fasteners therethrough to fasten said door striker to one of the panels of the vehicle door receiving aperture.

6. A door striker assembly in accordance with claim 2 wherein said sections of said bracket are angled at about ninety degrees to each other, and said rod is bent at about a ninety degree angle, the sections of said rod extending perpendicularly into said bracket sections.

7. A door striker assembly in accordance with claim 2 wherein the width of said base area between said bracket sections about 2.5 to about 7.5 times the diameter of said rod.

8. A door striker assembly for a vehicle having a vehicle door and a vehicle door receiving aperture, the vehicle door receiving aperture including two panels at an angle of substantially less than 180 degrees to each other, the vehicle door being movable from an open to a closed position, and having a vehicle door latch mechanism, comprising:

an integral metal bracket having two sections, said two sections each having a base and an apex, and being joined together at their base area at an angle of less that 180 degrees to fit against the two panels of the door aperture;

a generally L-shaped metal rod extending between said bracket sections and having ends rigidly joined to said bracket sections generally in the area of the apices of the bracket sections, a segment of said L-shaped rod extending generally parallel to said door in its closed position, and another segment of said rod extending generally perpendicular to said door in its closed position, said rod having a diameter and being adapted to be engaged by the vehicle door latch mechanism;

a revetment formed in said bracket between the joining of said rod ends to said bracket sections;

apertures located in one of said bracket sections laterally of said rod to receive fasteners therethrough to fasten said door striker assembly to said vehicle body;

the width of said base area between said bracket sections being about 2.5 to about 7.5 times the diameter of said rod;

said bracket, rod, and revetment cooperating to form a rigid assembly.

9. A door striker in accordance with claim 8, wherein said bracket sections are joined at about at ninety degree angle.

10. A door striker assembly in accordance with claim 8 wherein said the width of said base area between said bracket sections is equal to about 4.0 to about 5.0 times the diameter of said rod.

11. A door striker assembly in accordance with claim 8 capable of withstanding longitudinal forces in excess of 5500 pounds force, and transverse forces in excess of 5000 pounds force.

12. A door striker in accordance with claim 8 wherein said bracket sections are generally polygonal in shape.

13. A door striker in accordance with claim 12 wherein one of said bracket sections is generally triangular, and one of said bracket sections is generally hexagonal, and wherein said apertures are located in said hexagonal bracket section.

14. A door striker assembly for a vehicle having a vehicle body with a vehicle door receiving aperture and a vehicle door, the vehicle door having a vehicle door latch mechanism and being movable from an open to a closed position, the vehicle door receiving aperture including two panels at about a ninety degree angle to each other, of which one panel extends generally parallel to the vehicle door in its closed position, and one panel extends generally perpendicular to the vehicle door in its closed position; comprising:

an integral metal bracket having two sections joined together at about a ninety degrees angle to conform with the angle between said door receiving aperture panels, one said bracket section being adapted to fit against one said door aperture panel, the other said bracket section being adapted to fit against the other said door apertures panel, the base area joining said bracket sections having a substantial width to provide said bracket with substantial structural strength;

means for engagement with the vehicle door latch mechanism extending between and rigidly affixed to said bracket sections;

means for mounting said bracket to the vehicle door receiving aperture;

said means for engagement and said bracket cooperating to form a rigid structure.

15. A door striker assembly in accordance with claim 14 wherein said means for engagement comprises a rod having a diameter and two sections joined at an angle such that one rod section extends generally parallel to said door in its closed position, and one rod section extends generally perpendicular to said door in its closed position, said rod sections intersecting and being joined with said bracket sections.

16. A door striker assembly in accordance with claim 15 wherein said bracket further comprises a revetment extending between the joining locations of said rod sections to said bracket sections.

17. A door striker assembly in accordance with claim 16 wherein the width of said base area between said bracket sections is about 2.5 to about 7.5 times the diameter of said rod.

18. A door striker assembly in accordance with claim 17 wherein the width of the base area between said bracket sections is about 4.0 to about 5.0 times the diameter of said rod.

19. A door striker assembly in accordance with claim 17 capable of withstanding longitudinal forces in excess of 5500 pounds force, and transverse forces in excess of 5000 pounds force.

20. A door striker in accordance with claim 17 wherein said bracket sections are generally polygonal in shape.

21. A door striker in accordance with claim 20 wherein one of said bracket sections is generally triangular, and one of said bracket sections is generally hexagonal.

22. A door striker assembly in accordance with claim wherein said sections of said rod extend perpendicularly into said two bracket sections.

23. A door striker assembly in accordance with claim 17 wherein said means for mounting comprises apertures located in at least one of said bracket sections laterally of said means for engagement to receive fasteners therethrough to fasten said bracket to at least one of said door aperture panels.

24. A door striker assembly for a vehicle having a vehicle door and a vehicle door receiving aperture, the vehicle door having a vehicle door latch mechanism, comprising:

an integral bracket having two polygonal sections joined together in a base area at an angle of about ninety degrees, the joining base area between said sections having a substantial width to provide substantial structural strength to said bracket;

a rod for engagement by the door latch mechanism, said rod having two sections joined at about a ninety degree angle, the rod sections perpendicularly intersecting and being joined with said bracket sections, said rod having a diameter, and said bracket base area width being between about 2.5 to about 7.5 times the diameter of said rod;

means for mounting said bracket to the vehicle door receiving aperture;

said rod and said bracket cooperating to form a rigid structure.

25. A door striker assembly for a vehicle having a vehicle door and a vehicle door receiving aperture, the vehicle door having a vehicle door latch mechanism, comprising:

an integral bracket having two polygonal sections joined together in a base area at an angle of about ninety degrees, the joining base area between said sections having a substantial width to provide substantial structural strength to said bracket;

a rod for engagement by the door latch mechanism, said rod having two sections joined at about a ninety degree angle, the rod sections perpendicularly intersecting and being joined with said bracket sections, said rod having a diameter, and said bracket base area width being between about 2.5 to about 7.5 times the diameter of said rod;

means for mounting said bracket to the vehicle door receiving aperture;

said rod and said bracket cooperating to form a rigid structure.

* * * * *